US005273464A

United States Patent [19]

Rushing

[11] Patent Number: 5,273,464

[45] Date of Patent: Dec. 28, 1993

[54] STRIP CONNECTOR FOR MULTIPLE LEADS

[76] Inventor: John A. Rushing, 1165 Tern Dr., Palatine, Ill. 60067

[21] Appl. No.: 954,564

[22] Filed: Sep. 30, 1992

[51] Int. Cl.[5] ..... H01R 11/09

[52] U.S. Cl. ..... 439/723; 439/512; 362/234

[58] Field of Search ..... 439/718, 723, 724, 787, 439/796, 907, 507, 512, 513; 362/227, 234, 249, 253

[56] References Cited

U.S. PATENT DOCUMENTS

| | | | |
|---|---|---|---|
| 2,453,925 | 11/1948 | Mendonca . | |
| 2,877,442 | 3/1959 | Gettig | 439/723 X |
| 3,036,206 | 5/1962 | Holbrook . | |
| 3,039,037 | 6/1962 | Daniels et al. | 439/723 X |
| 3,376,542 | 4/1968 | Vlaminck | 439/723 X |
| 3,723,723 | 3/1973 | Lerner . | |
| 4,148,546 | 4/1979 | Wilson, Jr. et al. | 439/724 X |
| 4,516,817 | 5/1985 | Deters | 439/513 |
| 4,860,179 | 8/1989 | Mui et al. . | |
| 5,053,931 | 10/1991 | Rushing . | |

*Primary Examiner*—Larry I. Schwartz
*Assistant Examiner*—Khiem Nguyen
*Attorney, Agent, or Firm*—John G. Tolomei

[57] ABSTRACT

A connector bus and terminal block arrangement provides quick and secure solderless connections for the parallel connection of multiple power leads. The terminal bus uses an elongate strip of conductive material to electrically connect a multiplicity of terminal wires to a power lead in a solderless connection using a series of resiliently formed clips that provide rapid assembly of the wires in a secure connection. The connector arrangement facilitates its use in a terminal block arrangement that receives the connector in an electrically insulated arrangement. In addition, the terminal block has an arrangement that protects the connector from rain and water.

20 Claims, 3 Drawing Sheets

STRIP CONNECTOR FOR MULTIPLE LEADS

FIELD OF THE INVENTION

This invention relates to electrical connectors. More specifically this invention relates to a connector arrangement for placing a plurality of electrical leads in contact with a single power lead and a terminal block arrangement for retaining the connector and power lead.

DESCRIPTION OF THE PRIOR ART

A variety of connectors are known for attaching a multiplicity of load leads to a central power lead. Often such connectors are used in arrays of miniature lights that use household alternating current supply or direct current to provide illumination or decoration. Such lighting arrangements have been disclosed for use as Christmas tree decorations. U.S. Pat. No. 3,723,723 issued to Lerner shows a miniature Christmas tree light arrangement having a plurality of light strings arranged with individual lights in series and all of the stings connected in parallel to a central connection block. Another arrangement of multiple strings of Christmas tree lights is shown in U.S. Pat. No. 2,453,925 issued to Mendonca. The arrangement of Mendonca teaches the electrical connection of the light strings to central connector plates which are also connected to a household power cord. U.S. Pat. No. 3,036,206 to Holbrook shows an arrangement for the electrical connection of multiple light strings in parallel using a central connection section and a cover for the top of the connection block. Such arrangements are also used to illuminate umbrellas as shown in U.S. Pat. No. 4,860,179 issued to Mui et. al. and U.S. Pat. No. 5,053,931 issued to Rushing.

It is an object of this invention to provide a simplified electrical connector for the parallel and orderly connection of multiple load leads or terminal wires.

It is a further object of this invention to provide a simplified electrical connector for a terminal block arrangement that electrically connects a plurality of terminal wires in parallel to a power supply lead.

It is a yet further object of this invention to provide an improved terminal block arrangement that is easily assembled to connect a multiple terminal wire connector in parallel with multiple terminal wires and with a power supply lead in a covered and insulated device.

A yet further object of this invention is to provide a terminal block arrangement for the outdoor or indoor use that electrically connects a plurality of miniature light strings.

BRIEF SUMMARY OF THE INVENTION

This invention uses an elongate strip of conductive material to electrically connect a multiplicity of terminal wires to a power lead in a solderless connection using a series of resiliently formed clips that provide rapid assembly of the wires in a secure connection. The connector arrangement facilitates its use in a terminal block arrangement that receives the connector in an electrically insulated arrangement. In addition, the terminal block has an arrangement that protects the connector from rain and water.

Accordingly in a broad embodiment this invention is an electrical connector having a connector bus for electrically connecting a plurality of plate connectors. the connector bus comprises an elongate conductive strip of material. A plurality of spaced apart resilient clips retain said plate connectors in electrical contact with the elongate conductive strip.

In another embodiment this invention is a terminal block arrangement for electrically connecting a plurality of terminal wires with a power lead. The arrangement includes a molded insulating terminal block, a power lead extending into the terminal block, an elongate conductive strip electrically connected to the power lead, a plurality of terminal wires, a plurality of connectors having each terminal wire attached to only one connector, and at least one clip for resiliently retaining each connector in electrical connection with the elongate conductive strip.

In a yet further embodiment this invention is a terminal block arrangement for electrically connecting a plurality of light strings with a pair of power leads. The arrangement includes a molded insulating terminal block, a pair of power leads entering the bottom of the terminal block and extending up to the top of the terminal block, a pair of elongate conductive strips each electrically connected to one of the power leads, a plurality of light string leads, a plurality of connectors having each light string lead attached to only one connector, a plurality of clips for resiliently retaining each connector in electrical connection with the elongate conductive strip, a cavity formed in opposite sides of the terminal block for receiving the conductive strip with the connectors fixed therein, a plurality of lugs spaced apart along the bottom side of each of the cavities to provide a plurality of gaps through which the light string leads extend, and a cover extending over the top of the terminal block having sides for closing the cavities.

Additional embodiments, details and advantages of this invention are disclosed in the following detailed description.

DETAILED DESCRIPTION OF THE INVENTION

The terminal block arrangement of this invention is generally useful for electrically connecting a plurality of load lead or terminal wires in parallel to a hot or neutral power lead. The connector bus of this invention provides a compact electrical connection for a large number of such load leads or terminal wires. This arrangement has the advantage of securely fastening the terminal wires quickly in an orderly and solderless assembly. Typically the arrangement will be used to electrically connect hot and neutral leads of an ordinary household power cord or a direct current power source in parallel with a group of load leads and a group of return leads. Although the invention can be applied to a variety of uses, the most commonly expected use is in the connection of miniature light strings.

In the preferred form, a terminal block will house the connector bus. The terminal block normally receives the connector bus in a manner that electrically insulates the connector bus. In addition the terminal block can provide strain relief for the power leads of the power cord. Another form of the terminal block protects the connector bus from the elements thereby rendering the terminal block arrangement suitable for indoor or outdoor use.

Figure 1:
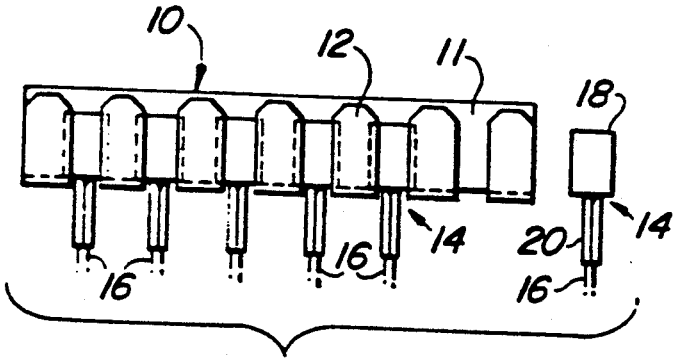
FIG. 1 is a front view of the connector bus of this invention.

Reference to FIG. 1 will facilitate the explanation of the general arrangement of the connector bus. FIG. 1 shows a connector bus 10, arranged in accordance with invention, in the form of an elongate conductive strip 11. Spaced apart clips 12 hold a multiplicity of plate connectors 14 against the strip 11 to electrically connect terminal wires 16 in a parallel power load arrangement. The connector bus 10 usually provides strip 11 in the form of a long flat plate, the strip can also have a curved form. The multiplicity of clips 12 are usually attached to the lower side of the plate 11 and integrally formed thereon. However the clips can also be provided at the end of wires 16 such that the connectors at the end of the wires clip onto the connector bus 10. Where the clips are attached to the ends of wires 16, strip 11 can be provided with protruding nibs to space the clips evenly along strip 11. Whether on the wires or the strip 11, the clips act resiliently against a plate portion of bus 10 to establish an electrical connection.

In preferred form, the clips 12 are an integral part of the base material of connector bus 10. In the embodiment of FIG. 1 the clips 12 are cut from the base material of connector bus 10 and folded over into resilient contact therewith. The clips are spaced apart to provide room for insertion of the connector terminals therebetween. The connector bus and clips are typically formed from a ductile conductive material such as brass or copper.

The plate connector 14 normally consists of an end plate 18 and a crimp connector 20. Crimp connector 20 electrically and mechanically connects a wire or wires 16 to the plate connector 14.

The connection between the wires and the connector bus is made by sliding plate connector 14 downward such that crimp connector 20 extends into the gap between the clips 12 and clips 12 hold at least the outer edges of plates 18. Each connector bus can retain a large number of terminal connectors. For this purpose several terminal connectors can be placed on top of each other and retained by the same pair of clips 12. The force of the clips 12 acting against the end plate 18 will in most cases keep the clips firmly secured in the connector bus. If desired, the terminal connectors can be more firmly secured into the connector bus by soldering the plate connectors in place or providing a locking tab (not shown) at the top of the connector bus to hold the terminal connector in place after insertion into the terminal bus.

Figure 2:
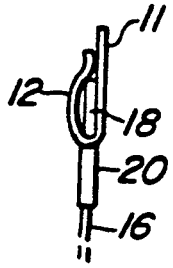
FIG. 2 is a section view of the connector bus of this invention taken along line 2—2.

In the preferred form of this invention each set of adjacent clips will secure only one plate connector and the top of the clip will recontact the upper portion of the strip 11 after insertion of the plate connector. FIG. 2 shows this preferred arrangement of connector bus 10 and plate connectors 18 in more detail. Generally the top and bottom of plate connector 18 will contact opposite ends of the clips when the secured therein.

Figure 3:
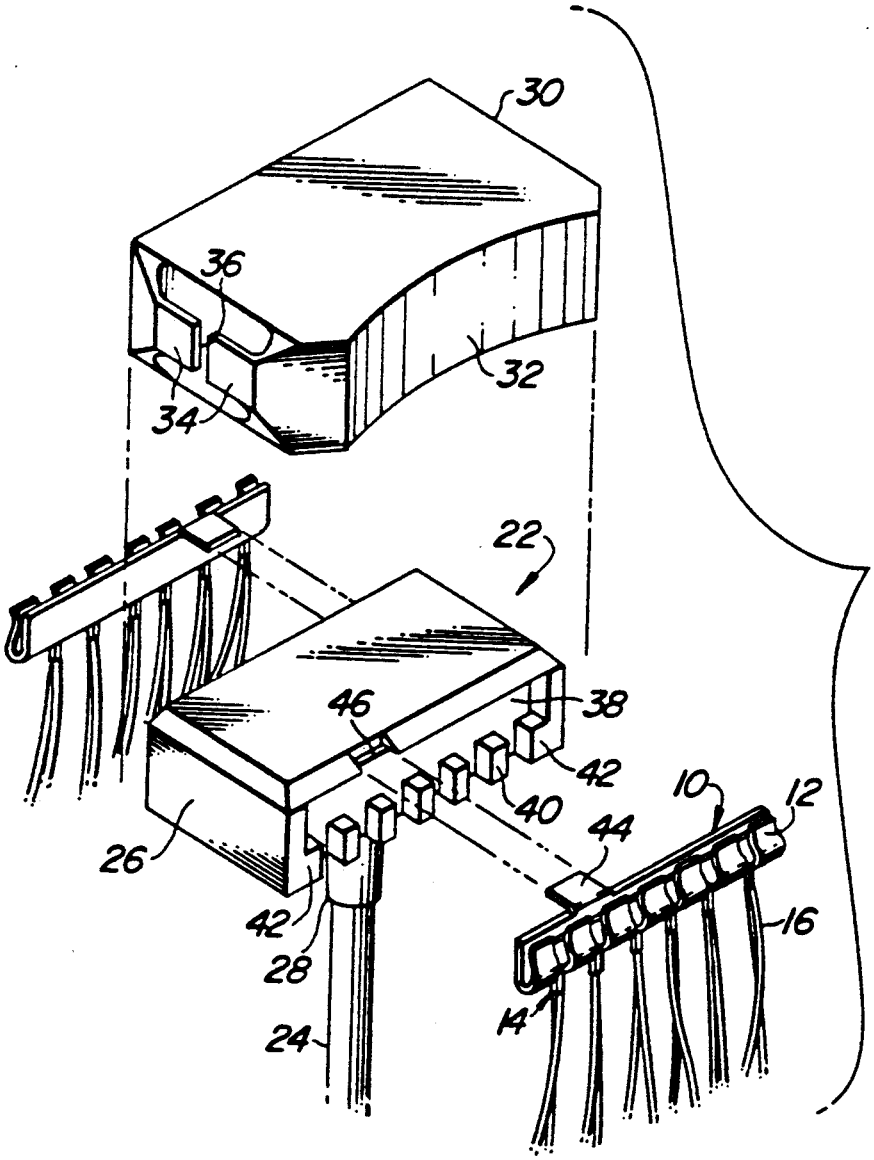
FIG. 3 is an expanded perspective view of the terminal block arrangement showing the power lead, terminal block, plate contacts, terminal wires and cover.

FIG. 3 depicts the insertion of connector bus 10 into a terminal block arrangement of this invention. The terminal block arrangement 22 has a power cord 24 that enters terminal block 26 through a sleeve portion 28.

An outer cover 30 fits over terminal block 26. An arcuate surface 32 is formed on the back of the cover to facilitate its attachment to a round support pole. The shape of the cover can be varied to provide any desired shape that will facilitate its attachment and use. All of the sides and the top of cover 30 are typically impervious to moisture penetration. In the illustrated embodiment of this invention the cover is molded in a single section to provide the sealed top and sides. The water impermeable sides and top of the cover shield the inner portions of the terminal block from moisture. The cover can also provide a pair of tabs to collect and retain wires 16. In the embodiment of FIG. 3 a slot 36 separates a pair of tabs 34 to provide means for collecting the terminal wires on opposite sides of the assembled terminal block arrangement.

Overall, the terminal block is generally rectangular in shape and slides into a rectangular central cavity of cover 30. Preferably the terminal block will lock into place within the cover after its assembly. A relatively permanent insertion of terminal block 26 into the cover 30 is desired to preserve the integrity of the wiring located therein.

Terminal block 26 receives connector bus 10 into a cavity 38. The cavity normally has a depth at least equal to that of the connector bus to so that once inserted, connector bus 10 will not interfere with placement of cover 30. Insertion of connector bus 10 into cavity 38 and the closure of cover 30 electrically insulates the top and sides of the bus 10. A plurality of spaced apart lugs 40 border the bottom of cavity 38 and extend between the crimped portions 20 of plate connectors 14. Another pair of lugs 42 are at each end of cavity 38. Lugs 40 and 42 serve the dual purpose of retaining the bottom portion of connector bus 10 in cavity 38 while also electrically insulating the crimped portions of wires 16.

Preferably insertion of connector bus 10 into terminal block 26 also establishes an electrical connection between the power leads of power cord 24 and connector bus 10. For this purpose, the connector bus 10 and the terminal block can use a male and female terminal pair. FIG. 3 shows a blade type male terminal 44 extending outwardly from connector bus 10 in a direction perpendicular to the elongate direction of the bus. A slot 46 along the top of cavity 38 provides an opening to a female terminal, connected to one of the leads of power cord 24, (not shown) that receives the blade terminal as the connector bus 10 enters cavity 38. Slot 46 is offset from the center of the terminal block to prevent interference between the power leads at the top of the terminal block when the power cord extends through the top of the terminal block.

Figure 4:
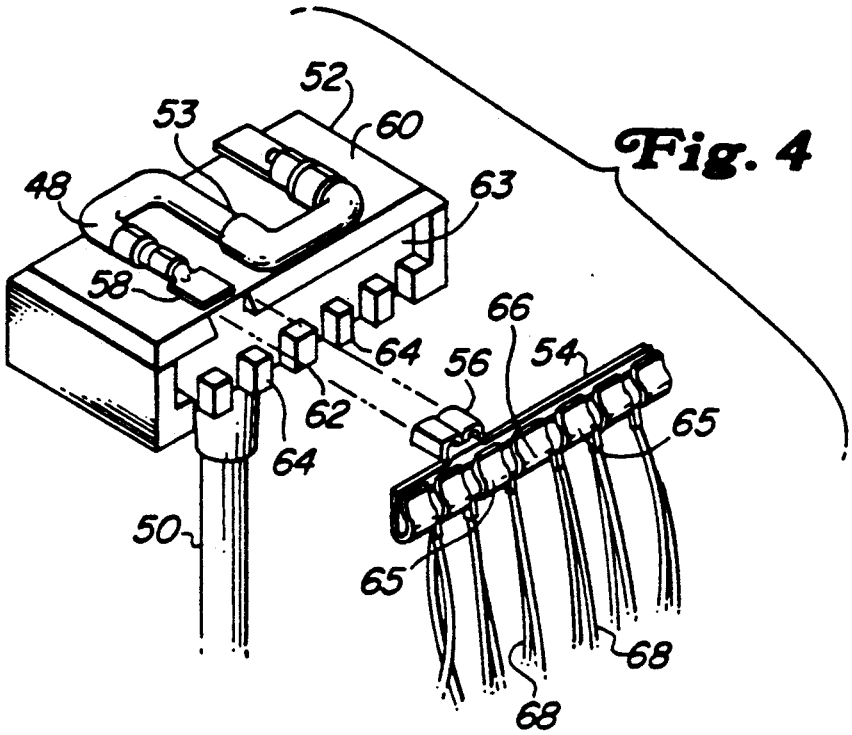
FIG. 4 depicts a terminal block arrangement which is similar to that shown in FIG. 3, but does not show the cover.

In FIG. 3 the ends of the power leads were enclosed in the top of the terminal block. FIG. 4 shows another form of the terminal block arrangement wherein a lead 48 from a power cord 50 extends out of the top of a terminal block 52 through an opening 53. A female terminal extending from connector bus 54 retains a blade type male terminal 58 that is crimped to lead 48. Connection of male terminal 58 and female terminal 56 hold power lead 48 in place on top 60 of terminal block 52. The bends in power lead 48 as it passes through opening 53 provide strain relief for the power cord 50.

FIG. 4 also depicts a preferred arrangement for the lugs of the terminal block and the clips of the connector bus. A lug 62 in the center of a cavity 63 has an extended width relative to the other lugs 64 located along the bottom of cavity 63. Similarly, clip 66 of connector bus 54 has a greater width than the remaining clips 65. The relatively increased width of lug 62 and clip 66 expands the separation between wires 68 at the center of the terminal block to eliminate or minimize interference between the wires 68 and the power cord 50.

Figure 5:
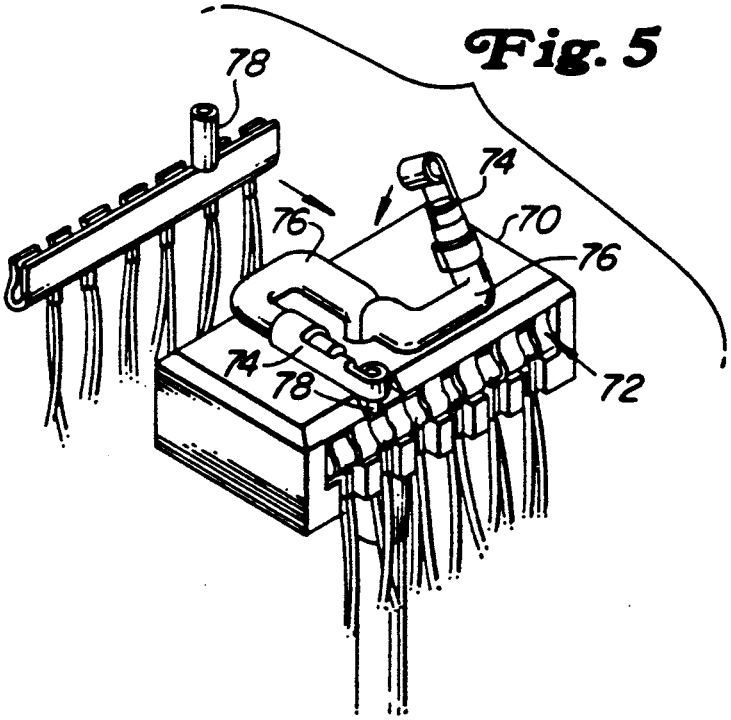
FIG. 5 is another terminal block arrangement that is similar to that shown in FIG. 4.

FIG. 5 shows a terminal block 70 with a connector bus 72 placed within the corresponding cavity of terminal block 70. FIG. 5 also depicts a barrel type female terminal 74 crimped onto power leads 76 for retaining a pin type terminal 78 that extend upwardly from terminal bus 72.

Figure 6:
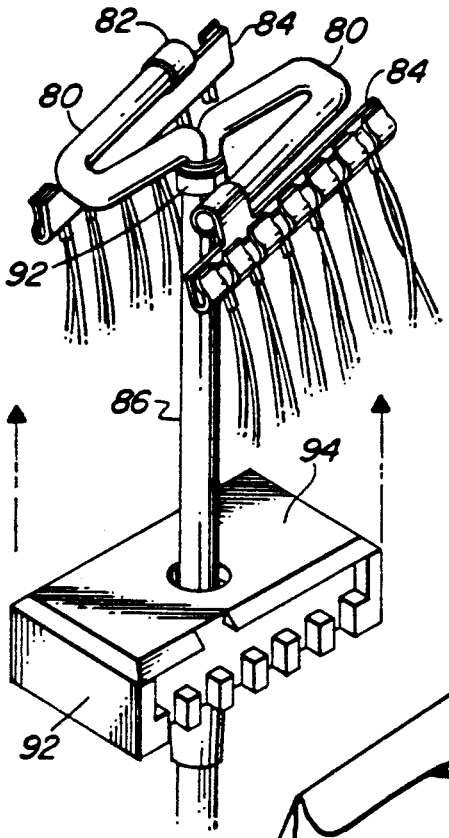
FIG. 6 is a terminal block arrangement similar to that shown in FIGS. 4 and 5 having a modified power lead.

Another embodiment of this invention, as illustrated in FIG. 6, uses a direct crimped connection 82 to connect power lead 80 directly to a connector bus 84. In the other terminal block arrangements, shown in FIGS. 3–5 the power cord was preferably molded in place with the terminal block to provide additional strain relief for the power cord. In the terminal block arrangement of FIG. 6, a power cord 86 has a sliding fit through a hole 88 in the center of terminal block 90 and a split ring 92 at the top of power cord 86 contacts the top 94 of terminal block 90 to provide strain relief for the power cord.

Figure 7:
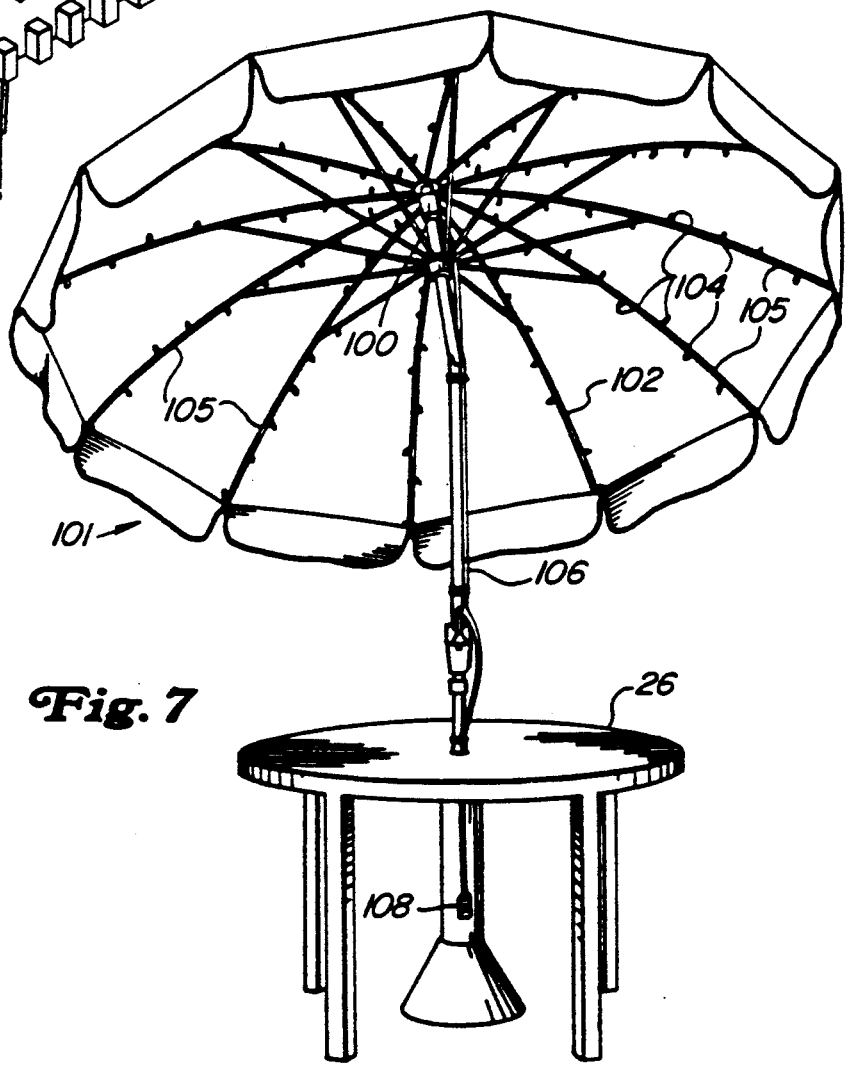
FIG. 7 is a perspective view of an outdoor umbrella having a plurality of light strings using the terminal block arrangement of this invention.

Although the connector bus and terminal block of this invention can have a variety of uses, it is particularly useful for the connection of miniature light strings. The cover of the terminal block arrangement makes it especially useful for a variety of outdoor lighting applications. A particularly preferred arrangement is shown in FIG. 7 where the terminal block arrangement of this invention connects a plurality of light strings under an outdoor patio umbrella 101. The use and arrangement of light strings for illuminating a patio umbrella is fully described in U.S. Pat. No. 5,053,931, the contents of which are incorporated herein by reference. Basic elements of the lighting arrangement include a terminal block arrangement 100, a plurality of wires 102 for light strings that extend from block 100 and have miniature lights 104 wired thereto along the ribs 105 of the umbrella, and a single power cord 106 that supplies power to the terminal block. Enough lights are provided in each string to provide a spacing of approximately four to eight inches between miniature lights. The power cord is connected to an ordinary household electrical outlet by the two prong plug 108. Plug 108 has a GFCI (ground fault circuit interrupter) incorporated therein which may be substituted by a D.C. converter. The terminal block can supply power to a large number of light strings. Typically there will be from 8 to 12 strings of lights connected to the central connector.

When installed terminal block 100 is located in a vertical position as shown in FIG. 7. All of the light strings 102 and the power cord 106 enter through the bottom of the terminal block 100. It is preferred that the terminal block and cover be made from materials that are resistant to ultra violet radiation, flame retardant and able to withstand impact at temperatures of less than minus twenty degrees centigrade. Accordingly with these properties the lighting arrangement is suitable for use in most indoor or outdoor applications.

The description of this invention in the context of the specific embodiment of the drawings is not meant to limit the invention to the details shown therein.

I claim:

1. A connector bus for electrically connecting a plurality of plate connectors to a single power lead, each of said plate connectors comprising a plate and an electrical lead fixed to a bottom side of said connector, said connector bus comprising an elongate strip of electrically conductive material and a plurality of spaced apart resilient clips that retain said plate connectors in electrical contact with the elongate conductive strip, wherein at least two adjacent clips together retain each of said plate connectors and the bottom side of the plate connector is adapted to contact closed ends of said at least two adjacent clips.

2. The connection terminal of claim 1 wherein said elongate conductive strip includes an extended imperforate flat plate section, said clips act against said flat plate section, said clips and flat plate section are integrally formed from a continuous material, and each of said plate connectors are retained by two of said clips.

3. The connector bus of claim 1 wherein said elongate conductive strip is connected to a power lead by a male terminal and a female terminal, one of said male or female terminal extends from the strip and the other of said terminals is fixed to said power lead.

4. A terminal block arrangement for electrically connecting a plurality of terminal wires with a power lead, said arrangement comprising:

a molded insulating terminal block;

a power lead extending into said terminal block;

an elongate conductive strip electrically connected to said power lead;

a plurality of terminal wires;

a plurality of connectors having each terminal wire attached to only one connector; and, at least two clips that act in combination for resiliently retaining each connector in electrical connection with said elongate conductive strip and at least one clip that in combination with at least two other clips retains at least two connectors in electrical connection with said elongate conductive strip.

5. The terminal block of claim 4 wherein said clips are integrally formed on said elongate conductive strip, said connectors are plate connectors and said clips retain said plate connectors.

6. The terminal block of claim 4 wherein two of said terminal wires are attached to each of said connectors.

7. The terminal block of claim 4 wherein said elongate conductive strip is electrically connected to said power lead by a male and female terminal pair.

8. The terminal block of claim 4 wherein a cavity for retaining said elongate conductive strip is formed on opposite sides of said terminal block.

9. The terminal block of claim 8 wherein said power lead extends into a central portion of said terminal block, means are provided for positioning said connectors along said elongate conductive strip and said means for positioning increases the distance between adjacent connectors at the central portion of said elongate conductive strip.

10. The terminal block of claim 8 wherein a plurality of lugs are formed along one side of said cavity to separate the terminal wires that are connected to adjacent connectors.

11. The terminal block of claim 8 wherein said arrangement has a cover to conceal the elongate conductive strip and the connectors.

12. The terminal block of claim 8 wherein said elongate conductive strip is electrically connected to said power lead by a male and female terminal pair and one of said male and female terminal pair is integrally formed on and extends from said conductive strip.

13. The terminal block of claim 12 wherein said male terminal is formed on said conductive strip and said female terminal is fixed in said terminal block to receive said male terminal as said conductive strip is located in said cavity.

14. A terminal block arrangement for electrically connecting a plurality of light strings with a pair of power leads, said arrangement comprising:

a molded insulating terminal block;

a pair of power leads entering the bottom of said terminal block and extending up to the top of said terminal block;

a pair of elongate conductive strips each electrically connected to one of said power leads;

a plurality of load leads;

a plurality of connectors having each load lead attached to only one connector;

a plurality of clips for resiliently retaining each connector in electrical connection with said elongate conductive strip a pair of cavities each formed in opposite sides of said terminal block for receiving one of said conductive strips with said connectors fixed therein;

a plurality of lugs spaced apart along a bottom side of each of said cavities to provide a plurality of gaps through which said light string leads extend; and, a cover extending over the top of said terminal block having sides for closing said cavities.

15. The terminal block arrangement of claim 14 wherein a male and female terminal pair electrically connects each of said elongate conductive strips to one of said power leads.

16. The terminal block arrangement of claim 15 wherein said plurality of resilient clips are integrally formed on said elongate conductive strips.

17. The terminal block arrangement of claim 16 wherein said plurality of clips includes a central clip that is wider than the other clips in said plurality of clips and said plurality of lugs includes a central lug that is wider than other lugs in said plurality of lugs.

18. The terminal block arrangement of claim 17 wherein said male and female terminal pair extends perpendicularly from a principal direction of said elongate conductive strip.

19. The terminal block arrangement of claim 18 wherein the female terminal of said terminal pair is positioned in said terminal block to receive a male terminal when said elongate conductive strips are placed in said cavities.

20. The terminal block arrangement of claim 14 wherein at least two light string leads are attached to each connector.

* * * * *